US007908784B2

(12) United States Patent
Kim

(10) Patent No.: US 7,908,784 B2
(45) Date of Patent: Mar. 22, 2011

(54) ACCESSORY MOUNT APPARATUS

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 1 day.

(21) Appl. No.: 12/655,390

(22) Filed: Dec. 30, 2009

(65) Prior Publication Data

US 2010/0154276 A1 Jun. 24, 2010

Related U.S. Application Data

(62) Division of application No. 11/159,504, filed on Jun. 22, 2005, now Pat. No. 7,669,359.

(51) Int. Cl.
*F41G 1/16* (2006.01)

(52) U.S. Cl. ..... 42/146

(58) Field of Classification Search ..... 42/146; 403/322.1, 324, 325, 326, 327, 322.3
See application file for complete search history.

(56) References Cited

U.S. PATENT DOCUMENTS

| | | | | |
|---|---|---|---|---|
| 911,621 | A | | 2/1909 | Smit |
| 2,073,210 | A | | 3/1937 | Horsrud |
| 2,143,167 | A | | 1/1939 | Pechar |
| 2,336,107 | A | | 12/1943 | Litschert |
| 2,491,431 | A | | 12/1949 | Unertl et al. |
| 2,597,565 | A | * | 5/1952 | Gordon et al. ..... 362/110 |
| 2,775,817 | A | | 1/1957 | Schuman |
| 3,208,318 | A | * | 9/1965 | Roberts ..... 81/177.85 |
| 3,368,454 | A | | 2/1968 | Peck et al. |
| 3,979,848 | A | | 9/1976 | Ackerman, Jr. |
| 4,218,940 | A | * | 8/1980 | Main ..... 81/63 |
| 4,483,639 | A | * | 11/1984 | McCandless, II ..... 403/317 |
| 4,533,980 | A | * | 8/1985 | Hayes ..... 362/110 |
| 4,614,457 | A | * | 9/1986 | Sammon ..... 403/322.2 |
| 4,692,049 | A | * | 9/1987 | Engle ..... 403/1 |
| 4,742,636 | A | | 5/1988 | Swan |
| 4,845,871 | A | | 7/1989 | Swan |
| 4,865,485 | A | * | 9/1989 | Finnefrock, Sr. ..... 403/322.2 |
| 5,092,071 | A | | 3/1992 | Moore |
| 5,198,600 | A | | 3/1993 | E'Nama |
| 5,390,571 | A | * | 2/1995 | Fox et al. ..... 81/177.85 |
| 5,400,540 | A | | 3/1995 | Solinsky et al. |
| 5,430,967 | A | * | 7/1995 | Woodman et al. ..... 42/114 |
| 5,531,140 | A | * | 7/1996 | Chow ..... 81/177.85 |
| 5,590,484 | A | | 1/1997 | Mooney et al. |
| 5,704,155 | A | | 1/1998 | Primeau, IV |
| 5,816,683 | A | * | 10/1998 | Christiansen ..... 362/110 |
| 5,826,363 | A | | 10/1998 | Olson |
| 5,941,489 | A | | 8/1999 | Fanelli et al. |

(Continued)

OTHER PUBLICATIONS

United States Department of Defence, Military Standard: Dimensioning of Accessory Mounting Rail for Small Arms Weapons, MIL-STD 1913, Feb. 3, 1995.

*Primary Examiner* — Michael Carone
*Assistant Examiner* — Jonathan C Weber

(57) ABSTRACT

Block-bracing apparatus including at least three plugs threadedly engageable through a block, and retaining rings engaging the block threaded oppositely to the threaded plugs and retainably engaging the plugs. A key tool is provided to tighten the plugs and retaining rings. A longitudinally oriented T-rail projects radially from the block. A slide body engages the T-rail and includes a locking mechanism, a lamp assembly, a logically switched power control, a power cable, and a control cable with interchangeable switches.

7 Claims, 12 Drawing Sheets

U.S. PATENT DOCUMENTS

| | | | | |
|---|---|---|---|---|
| 5,956,190 | A | 9/1999 | Sieg | |
| 6,003,414 | A * | 12/1999 | Hsieh | 81/177.85 |
| 6,006,632 | A * | 12/1999 | Hsieh | 81/177.85 |
| 6,250,842 | B1 * | 6/2001 | Kruger | 403/315 |
| 6,381,895 | B1 | 5/2002 | Keeney et al. | |
| 6,394,687 | B1 * | 5/2002 | Lee | 403/96 |
| 6,442,883 | B1 | 9/2002 | Waterman et al. | |
| 6,490,822 | B1 | 12/2002 | Swan | |
| 6,508,027 | B1 | 1/2003 | Kim | |
| 6,523,441 | B2 * | 2/2003 | Lee | 81/177.85 |
| 6,574,901 | B1 * | 6/2003 | Solinsky et al. | 42/146 |
| 6,618,976 | B1 | 9/2003 | Swan | |
| 6,626,951 | B1 * | 9/2003 | Gramnas | 623/33 |
| 6,655,069 | B2 | 12/2003 | Kim | |
| 6,671,990 | B1 | 1/2004 | Booth | |
| 6,694,660 | B1 | 2/2004 | Davies | |
| 6,705,037 | B2 | 3/2004 | Van Kirk | |
| 6,755,100 | B1 * | 6/2004 | Chen | 81/177.85 |
| 6,779,288 | B1 | 8/2004 | Kim | |
| 6,785,997 | B2 | 9/2004 | Oz | |
| 6,823,762 | B2 * | 11/2004 | Hu | 81/177.85 |
| 6,895,708 | B2 | 5/2005 | Kim et al. | |
| 7,013,592 | B2 | 3/2006 | Olson et al. | |
| 7,066,678 | B2 * | 6/2006 | Huang | 403/321 |
| 7,140,277 | B1 * | 11/2006 | Chern | 81/177.85 |
| 7,188,978 | B2 * | 3/2007 | Sharrah et al. | 362/396 |
| 7,216,451 | B1 | 5/2007 | Troy | |
| 7,305,790 | B2 * | 12/2007 | Kay | 42/146 |
| 7,308,772 | B1 | 12/2007 | Millett | |
| 7,363,741 | B2 | 4/2008 | DeSomma et al. | |
| 7,365,924 | B1 | 4/2008 | Millett | |
| 7,493,722 | B2 * | 2/2009 | Howe et al. | 42/146 |
| 7,523,583 | B2 * | 4/2009 | Cheng | 42/146 |
| 2003/0106251 | A1 | 6/2003 | Kim | |
| 2004/0068913 | A1 * | 4/2004 | Solinsky et al. | 42/146 |
| 2004/0187374 | A2 * | 9/2004 | Solinsky et al. | 42/146 |
| 2005/0000142 | A1 | 1/2005 | Kim et al. | |
| 2005/0217162 | A1 * | 10/2005 | Matthews et al. | 42/146 |
| 2005/0246936 | A1 * | 11/2005 | Kay | 42/146 |
| 2005/0246937 | A1 * | 11/2005 | Kim | 42/146 |
| 2005/0257415 | A1 * | 11/2005 | Solinsky et al. | 42/146 |
| 2005/0262752 | A1 | 12/2005 | Robinson et al. | |
| 2006/0137234 | A1 | 6/2006 | Castagnozzi | |
| 2006/0196099 | A1 * | 9/2006 | Matthews et al. | 42/146 |
| 2006/0236582 | A1 | 10/2006 | Lewis et al. | |
| 2006/0242882 | A1 * | 11/2006 | Liu | 42/146 |
| 2006/0249466 | A1 | 11/2006 | Wang | |
| 2006/0288626 | A1 * | 12/2006 | Kim | 42/73 |
| 2007/0068059 | A1 * | 3/2007 | Kim | 42/146 |
| 2007/0074444 | A1 * | 4/2007 | Kim | 42/146 |
| 2007/0113461 | A1 * | 5/2007 | Wang | 42/146 |
| 2007/0113462 | A1 * | 5/2007 | Ho | 42/146 |
| 2007/0163163 | A1 | 7/2007 | Munst | |
| 2007/0227056 | A1 * | 10/2007 | Howe et al. | 42/146 |
| 2008/0072471 | A1 | 3/2008 | Keng | |
| 2008/0092421 | A1 | 4/2008 | Beckmann | |
| 2008/0134559 | A1 | 6/2008 | Swan | |
| 2010/0147117 | A1 * | 6/2010 | Hsieh | 81/177.85 |

* cited by examiner

ACCESSORY MOUNT APPARATUS

CROSS REFERENCE TO RELATED APPLICATION

This application is a division of co-pending U.S. patent application Ser. No. 11/159,504 filed Jun. 22, 2005, which application is incorporated in full herein by reference.

BACKGROUND OF THE INVENTION

The present invention addresses the problems encountered when attaching an accessory, such as a light beam generator or other optical apparatus, to a Browning M2 .50 caliber machine gun and then operating the accessory with the gun.

The Browning M2 machine gun (hereinafter "M2"), utilized by the U.S. armed forces, weighs about 35 kilograms and recoils heavily when fired. It is usually supported from beneath, sometimes by a tripod, more commonly by a post or pintle installed on a platform such as a vehicle, vessel or aircraft. If an accessory is to be aimed with the gun, it might as well be mounted on the gun. However, there is a need for a sturdy, secure way to attach an accessory to the M2.

The M2 has a shroud which is capable of supporting an accessory. The shroud is a substantially cylindrical cast metal shell which surrounds the gun barrel, is rigidly fixed to the body of the gun, and projects forward about 20 centimeters from the front of the body of the gun. The shroud has an outside diameter of about 8 centimeters and a shell thickness of about 0.7 centimeter. The shroud has a plurality of substantially circular perforations, about 2 cm in diameter, formed by casting or machining. As presently configured, the perforations are arranged in six sets of three. The three perforations of each set are spaced apart about 120° in a plane perpendicular to the longitudinal axis of the shroud. Successive sets of perforations are spaced apart about 1.5 cm longitudinally and offset by about 60°.

The shroud is an ordinary feature of many of the M2 machine guns that are in service. However, as will be discussed below in describing the present invention, there is a need in particular for a sturdy, secure way to support a growing inventory of accessories by utilizing the shroud.

SUMMARY OF THE INVENTION

It is an object of the present invention to utilize the shroud of the M2 machine gun for mounting a wide range of accessories in a sturdy, secure way and, in particular, to removably secure a light beam generator or light to the shroud of the M2 and to operate the light beam generator with the M2.

New accessories for the M2 are evolving. Some of these accessories, which include light beam generators and the like, have a mass of several kilograms and may extend as far as 40 centimeters laterally or vertically from the gun. Sometimes difficulties are encountered in mounting and operating such accessories. The present invention addresses a source of these difficulties, namely, that recoil, vibration, maneuvers and other rough treatment may knock the accessories out of alignment, loosen them, or separate them from the gun.

The shroud of the M2 is rigid and sturdy and is firmly attached to the gun. In attaching heavy or bulky accessories to the shroud, new difficulties may be encountered with the shroud itself. For example, the perforations of the shroud are not precisely machined, nor are they formed in precisely the same manner, shape and location in every shroud. In some older shrouds, the perforations were bored radially. In some newer ones, the perforations are formed as the shroud is cast, and thus they extend in the direction in which the casting is pulled. The present invention solves these problems by providing a way of stably attaching bulky, massive accessories to the shroud, taking advantage of the perforations of the shroud despite its variably shaped perforations.

The present invention also addresses other sources of difficulty in managing accessories in combination with the gun, including the need to avoid accidentally activating the accessory, wasting power, heating up the cable, or subjecting a mechanical switch to high current while working with light emitters or lamps having high power consumption.

In accordance with the present invention, an exemplary embodiment of an adapter for removably securing an accessory to a machine gun having a shroud about the gun barrel has a block adapted to embrace the shroud and at least one set of three plugs adjustably securable through the block and adapted to engage the shroud. Additionally, the block may encircle the shroud. Preferably, the plugs threadedly engage the block, especially by means of ACME threads. Additionally, retaining rings may threadedly engage the block in abutting relation to the plugs, preferably by means of threads having a pitch angle opposite that of the threads of the plugs.

The plugs may be at least partly convex-nosed. Preferably, the plugs are blunt-nosed and have a diameter predetermined to exceed the diameter of an identified surface feature of the shroud, such as the regularly arranged perforations formed in the shroud of the M2. Preferably, the plugs are adapted for smooth spiral advance into bracing contact with a surface of a shroud. Preferably, the plugs are bored out centrally. This saves weight.

The plugs may include tails adapted to engage a tool. For example, the tails may have a cruciform indentation for engaging a tool having a cruciform bit.

The retaining rings may encircle the tails when in the abutting relation to the plugs. This saves space. The retaining rings may be adapted to engage a second tool. For example, the retaining rings may have a plurality of bores adapted to engage a tool having a plurality of pegs.

The three plugs of the at least one set may be angularly spaced apart and located substantially within a first plane transecting the longitudinal axis of the shroud at a first point. This helps to balance the forces exerted by the plugs about the longitudinal axis of the shroud.

The block itself may include at least one rail adapted for mounting an accessory. The adapter may also include at least one rail adapted for mounting an accessory, the rail being securable to the block, preferably after the plugs and the retaining rings have been engaged in the block. The rail, when secured to the block, covers at least one of the plugs and at least one of the retaining rings. This takes advantage of the compact arrangement of the plugs and retaining rings when they are engaged in the block. Because the plugs and retaining rings protrude little or not at all from the block, a rail can be secured over them without interference.

The adapter may include a plurality of rails adapted for mounting accessories, a first of the rails being securable to the block when the plugs and the retaining rings are engaged in the block; the rail, when secured to the block, covering at least one of the plugs and at least one of the retaining rings; a second of the rails being so located on the block as not to cover any of the plugs and retaining rings. This provides a greater variety of positions at which an accessory may be mounted.

Additionally, a second set of three plugs may be included, also adjustably securable through the block and adapted to engage the shroud, also angularly spaced apart, but located substantially within a second plane transecting the longitudinal axis of the shroud at a second point longitudinally spaced apart from the first point. This second set of plugs further stabilizes the block on the shroud and further distributes the loads that are transmitted between the block and the shroud. This second point may be longitudinally separated from the first point by a distance equal to a longitudinal separation between recurrences of a predetermined surface feature of the shroud.

Additionally, the plugs in each of the sets of plugs may be angularly spaced apart an angle equal to a predetermined angular separation between recurrences of a predetermined surface feature of the shroud.

Also in accordance with the present invention, block-bracing apparatus includes a block; at least three plugs, engageable through the block via threads having a first orientation, the plugs having plug tails with a first tool-engaging adaptation; and at least three retaining rings, the retaining rings being positionable in abutting relation to the plugs and in surrounding relation to the tails, the retaining rings being engageable in the block via threads oriented opposite the first orientation, the retaining rings having a second tool-engaging adaptation. A two-ended key tool is provided and is adapted alternatively to engage the first and second tool-engaging adaptation. Preferably, the key tool has a first bit including a centrally located cruciform bit and a second bit including a plurality of peripherally arranged pegs.

The three plugs may be angularly spaced apart and located substantially within a first plane transecting the longitudinal axis of the shroud at a first point, and the apparatus may further include a second set of three plugs, adjustably securable through the block and adapted to engage the shroud, angularly spaced apart and located substantially within a second plane transecting the longitudinal axis of the shroud at a second point longitudinally spaced apart from the first point, for enhanced stability and load distribution.

Also in accordance with the present invention, apparatus for controlling a light emitter includes a logical switch electrically coupled to the light emitter; a power input cable electrically connectable to the logical switch and to an electric power source; a control input cable electrically connectable to the logical switch; and at least one control input device electrically connectable to the control cable for signaling the logical switch via the control input cable. This apparatus controls power to the light source without a heavy duty mechanical switch and without a heavy duty electric branch cable that might be required by such a switch. The control input device includes at least one switch, and may include a plurality of switches each having a plurality of states including an ON state, the control input device sending an ON signal only when at least two of the plurality of switches are set in the ON state as a safety measure to avoid unintentional illumination. The control input device may further include a hand grip containing at least one switch.

Also in accordance with the present invention, apparatus for mounting equipment includes a first component including a rail; a second component including a slide adapted for longitudinal engagement to the rail, the slide having an open end adapted for receiving the rail endwise; a lock movably confined in the second component proximate the open end, the lock having a closed position wherein the lock confines the rail in the open end and an open position wherein the open end may receive or release the rail; an appendage projecting from the lock; a pin movably confined in the second component proximate the lock, the control pin having a notch shaped and oriented to receive the appendage, the control pin having a free position wherein the notch is aligned to receive the appendage, thereby allowing the lock to be in the open position, and a blocking position wherein the notch is misaligned with the appendage, thereby preventing the lock from being in the open position.

Preferably, the lock is biased in the closed position. Also preferably, the control pin is biased in the blocking position and manually movable to the free position. The lock may have lateral projections adapted for manually moving the lock between the closed and open positions.

Preferably, the control pin is movable from the free position to the blocking position only when the lock is in the closed position. One preferred embodiment includes a first surface feature on the appendage and a second surface feature on the control pin, the first surface feature and the second surface feature being adapted to cooperate to retain the lock in the open position while the appendage retains the control pin in the free position. This makes it more convenient for the operator to use both hands to manipulate the slide relative to the T-rail.

Also in accordance with the present invention, a key tool for tightening a plurality of types of bolts includes a rigid core having an axis of rotation; a first side of the core, the first side including a first key bit aligned with the axis of rotation; a second side of the core, the second side including a second key bit aligned with the axis of rotation; and a rigid torque handle protruding from the core outside the axis of rotation. The torque handle may be slidably disposed through the core and, preferably, has enlarged ends so that it will not slide free of the core.

Also in accordance with the present invention, a method of attaching an accessory mounting block to a shroud of an M2 machine gun, comprising the steps of placing an accessory mounting block in embracing relation to the shroud; inserting at least three plugs through the block until they contact the shroud; and tightening the three plugs onto the shroud. The method may further include a step of placing the block in a preferred alignment with the shroud while tightening the plugs. It may also further include a step of securing a retaining ring behind each of the plugs after tightening the plugs.

The steps of inserting and tightening may include a rotation of the plugs in helically threaded engagement with the block resulting in an advancement of the plugs onto the shroud.

The method may further include a step of securing a retaining ring behind each of the plugs after tightening the plugs. The step of securing the retaining rings may include a rotation of the retaining rings in helically threaded engagement with the block resulting in an advancement of the retaining rings into abutting contact with the plugs after tightening the plugs. The step of securing the retaining rings may further include a rotation of the retaining rings opposite the rotation of the step of inserting and tightening the plugs.

The method may further include a step of finding perforations on the shroud and aligning the plugs with the perforations before tightening the plugs.

Additionally, a second set of plugs may be used, so that first and second sets of three plugs each are inserted and tightened, enhancing stability and better distributing loads.

Also in accordance with the present invention, firearm in combination with an accessory adapter comprises a firearm and a shroud fixed to the firearm. A plurality of perforations are formed in the shroud. A block is adapted to embrace the shroud. An accessory adapter is removably securable to the block. At least one set of three plugs are provided, the plugs being adjustably securable through the block and being adapted to engage the perforations of the shroud. Preferably, the plugs are located and oriented on the block such that each of the plugs is alignable with one of the perforations while the block embraces the shroud.

The present invention generally envisions a rigid block which embraces and tightly grasps the shroud, a robust body firmly mounted to the block, and an electrically efficient cable and control apparatus for discreetly controlling a light beam generator or other accessory installed on the body.

With the shroud as it is commonly found on the M2, the block may be fixed to the shroud at any of a plurality of predetermined discrete locations spaced apart along the longitudinal axis of the shroud. At each of those locations, the block may be fixed in any one of three angularly spaced apart positions, so that an accessory fixed relative to the block may be positioned, for example, below the shroud or to one side of it.

As the block is being located and positioned, its alignment is adjustable within a small range of angles. The block is then fixed rigidly to the shroud and remains so, even when subjected to acceleration and vibration. The accessory is rigidly fixed to the block via the body, which engages a rail located on the block.

Briefly summarized, the structural features of a mounted accessory, such as a light beam generator are as follows:

The block has at least three plugs which engage at least one set of three coplanar perforations of the shroud. In a preferred embodiment, the block has two sets of plugs, three plugs each, spaced apart longitudinally to engage the three perforations in each of two sets of perforations on the shroud.

In an exemplary embodiment, the block has bores which locate and orient each set of three plugs to face inward, radially, toward the longitudinal axis of the block, spaced apart 120° in a plane perpendicular to the longitudinal axis of the block.

The plugs, so located and so oriented, engage perforations of the shroud, which are spaced apart approximately 120° in a plane approximately perpendicular to the longitudinal axis of the shroud.

In a preferred embodiment, the plugs and the bores are helically threaded so that, when the plugs are turned clockwise in their bores, they advance into the perforations of the shroud. The plugs are dimensioned to be too large to pass through the perforations, yet small enough to nose into the perforations and stabilize the block on the shroud when tightened.

The block also receives retaining rings which, when secured in the block are in contact with the plugs after the plugs have been tightened and prevent the plugs from backing out from vibration or rough handling.

The retaining rings and their corresponding bores are threaded so that, when the retaining rings are turned counterclockwise in their bores, they advance toward the shroud until they abut the plugs.

In a preferred embodiment, the threads of the plug are the ACME type: they have a square profile, are very strong, and are relatively unlikely to back out when shaken.

Each plug has a bluntly curved front end surface for smoothly engaging a perforation of a shroud.

The rear surface of each plug has a cruciform arrangement of notches into which a cruciform key bit is insertable to tighten or loosen the plug.

The rear surface of each retaining ring has at least one and preferably two pair of bores into which pegs of a pegged key bit are insertable to tighten or loosen the retaining ring.

The key tool carrying the cruciform and pegged bits is cylindrical and has a short cruciform bit on one face, two pegs on the other face, and a metal bar torque handle slidably inserted through its center, with stops at the ends of the torque handle so that it will not separate from the key tool.

The structures for attaching accessories may include one or more accessory mounting rails for small arm weapons, for example such rails known as Picatinny rails per Mil. Std. 1913, for attaching light accessories.

For attaching heavy accessories, the present invention provides a new rail, referred to herein as a "T-rail," which is wider and sturdier than a Picatinny rail, and preferably has a rectangular-profiled central longitudinal groove. The T-rail may be formed integrally with the block, or it may be bolted onto the block.

A body is provided in accordance with the present invention for mounting an accessory such as a light beam generator. In a preferred embodiment, the body has a receiver portion which includes a slide and at least one guide post projecting into and riding in the groove, stabilizing the body as the retainer portion slides into or out of engagement with the T-rail. Additionally, the slide has a spring which also rides in the groove, so that less play is felt during engagement and disengagement of the retainer portion and the T-rail.

The retainer portion of the body in accordance with the present invention has a push-button-releasable, spring-loaded lock which prevents unintended disengagement of the body from the T-rail.

The body includes a forward-facing socket to which a light beam generator, camera, sight, or the like may be attached. The body also has an on-off switch and an electric socket for connecting electric power sources and controls. Where a high intensity discharge light source is attached to the apparatus housing included in a light beam generator, the apparatus housing also includes an internal electric ballast and an internal solid state logic switch.

A power and control cable provided in accordance with the present invention includes positive and negative power conductors, one or more control conductors, a connector matching these conductors to the electric socket on the body, a power source connector matching the power conductors to a socket of a power source, and one or more control input devices connected to the control conductors. A control input device may be a switch, in which case it may be incorporated into a handle and located on a branch cable. A gunner can, for example, hold the handle with one hand and operate the switch while aiming the M2 with both hands and operating its butterfly trigger with the other hand. Alternatively, a control input device may be located on a cable or in the apparatus housing and may be operable remotely via wireless signaling.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DETAILED DESCRIPTION OF THE PREFERRED EMBODIMENTS

Figure 1:
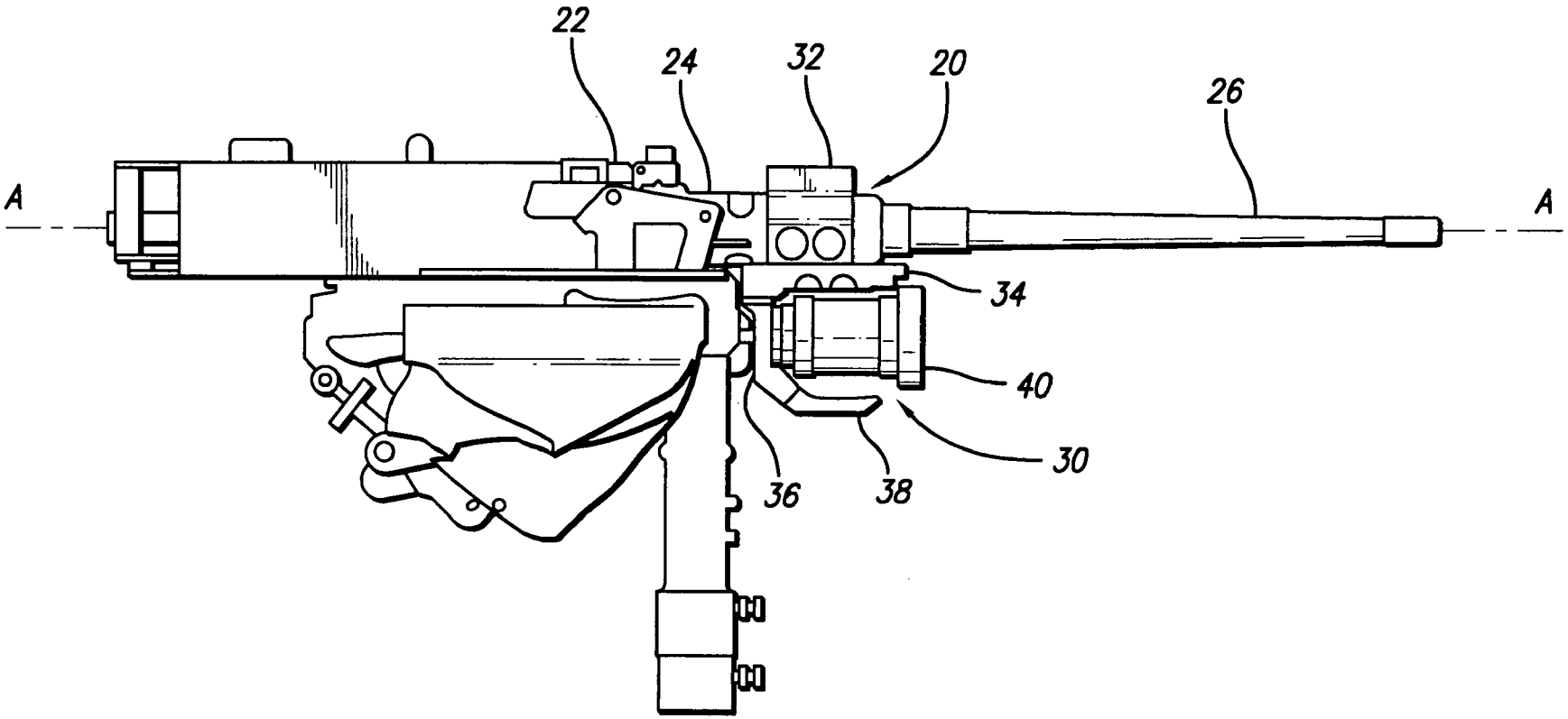
FIG. 1 is a side view of an M2 machine gun with an embodiment of an accessory mount adapter and a light beam generator accessory in accordance with the present invention mounted thereon.

The invention will now be described with reference to FIG. 1, which is a left side view of a first embodiment of an accessory mount adapter 20 and mounted light beam generator accessory 30 in accordance with the present invention mounted on a shroud 24 of an M2 machine gun 22 (viewing convention: "left side" is the side that would be on the viewer's left if the viewer was in front looking rearward), the longitudinal axis A being shown by a dotted line extending from the gunbarrel 26. The mounted light beam generator accessory 30 includes a body 34 with a stem 36, a handle 38, and a light emitter assembly 40. For installation, the block 32 is passed onto the muzzle end of the gunbarrel 26 and positioned so as to embrace the shroud 24. It is then secured as is described below. The body 34 is slide-mounted onto the block 32 as is also described below. The stem 36 extends from the slidable receiver portion 35 (see also FIG. 8) of the body 34; the handle 38 extends from the stem 36; and the lamp assembly 40 is carried by the body 34.

Figure 2:
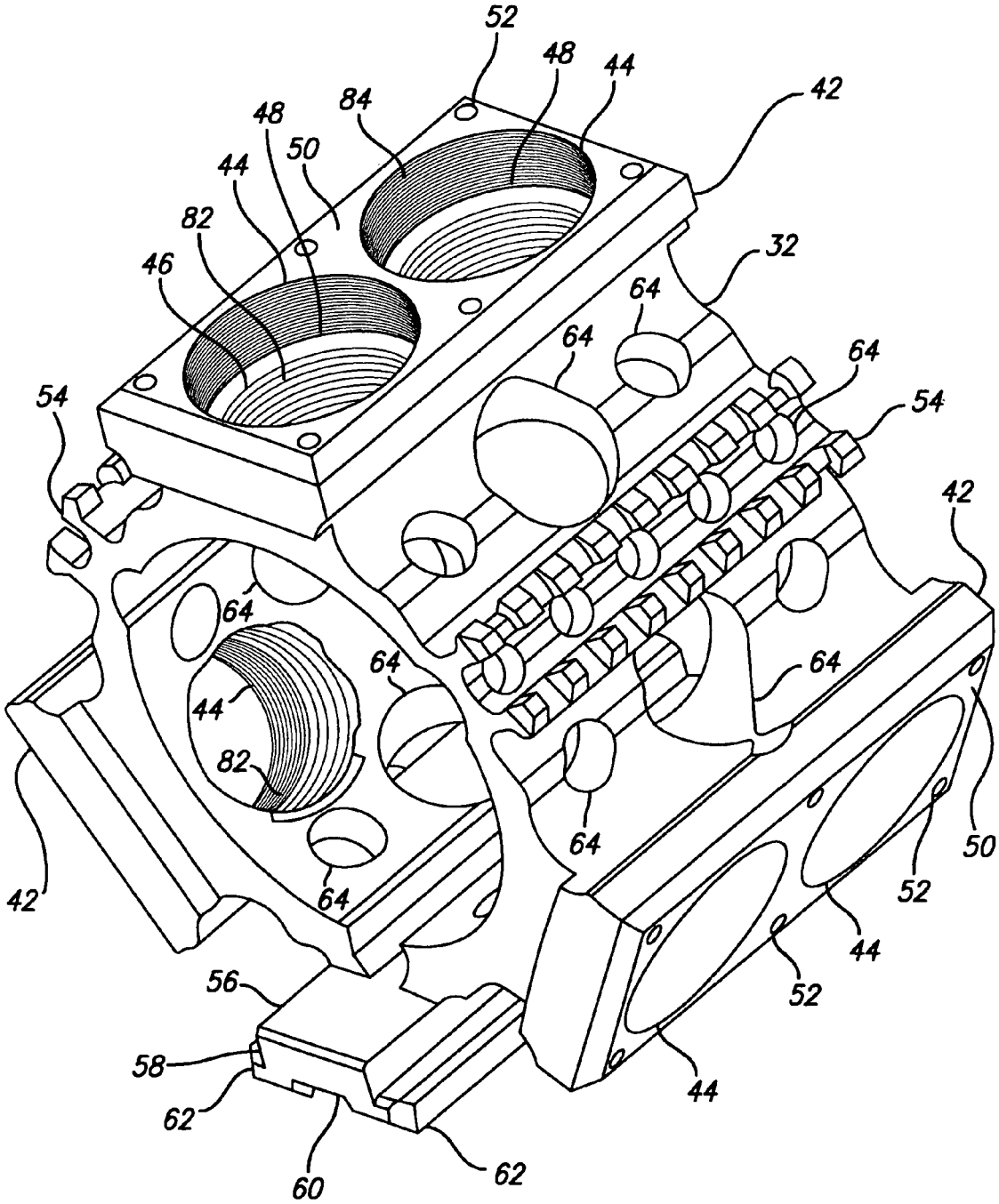
FIG. 2 is a perspective view of a block portion thereof.

With reference to FIG. 2, the generally tubular block 32 includes three heads 42 arranged circumferentially 120° apart, each head 42 having two longitudinally spaced apart, radially oriented main bores 44. Each main bore 44 has an inner segment 46 with clockwise internal threading 82 and an outer segment 48, having a greater diameter, with counterclockwise internal threading 84. Each head 42 has a radially outward facing seating surface 50 with six threaded auxiliary bores 52. Between the heads 42, arranged circumferentially 120° apart, are two radially projecting, longitudinally oriented mounting rail structures such as Picatinny rails 54. Vents 64 of various diameters are formed in the block 32.

With continued reference to FIG. 2, the block 32 includes at least one radially projecting, longitudinally oriented T-rail 56, which has a trunk 58, a longitudinally oriented, radially outward facing central groove 60, and laterally opposite wings 62.

Figure 3:
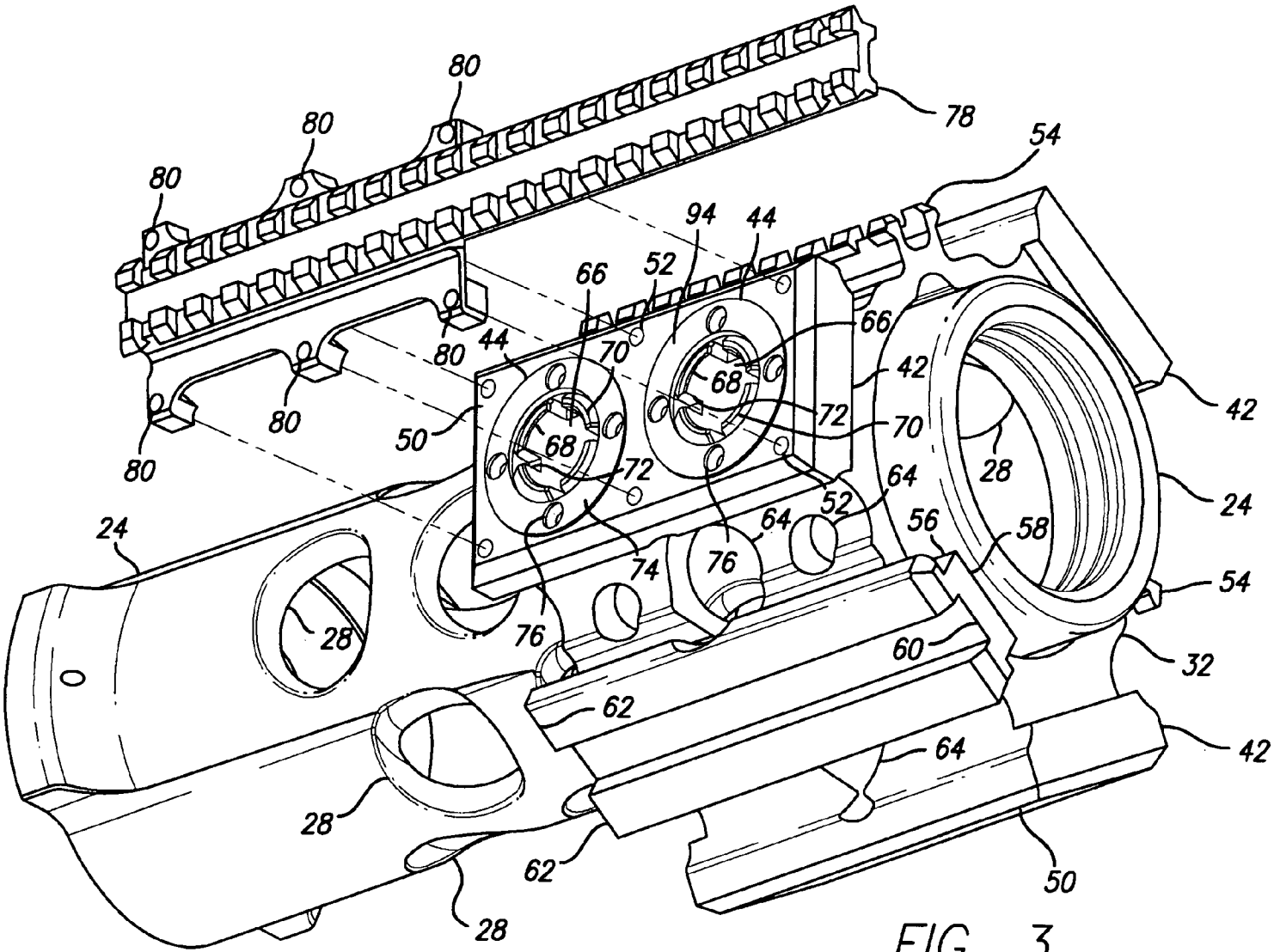
FIG. 3 is a perspective view of the block portion installed on an M2 shroud.
Figure 4:
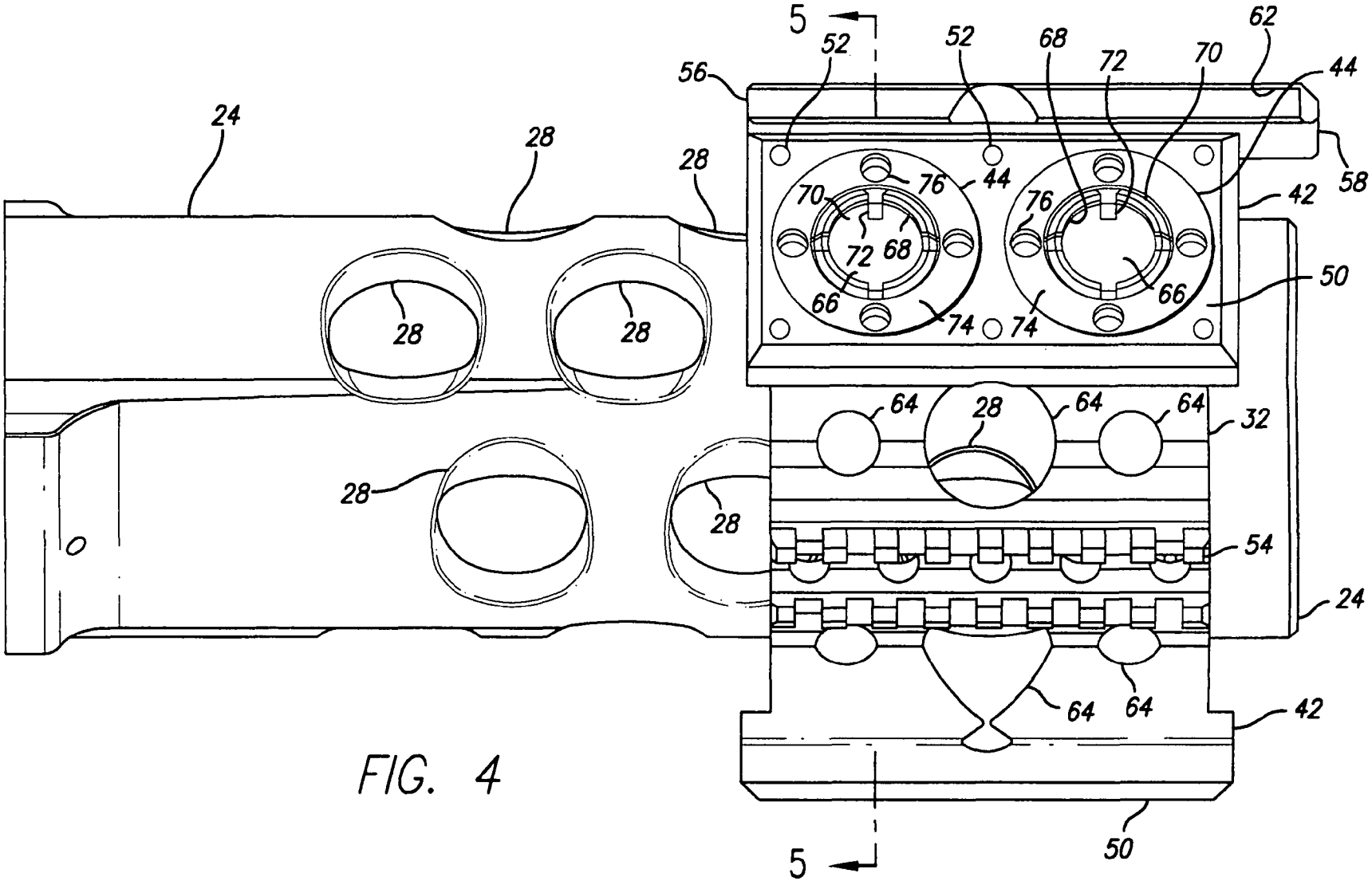
FIG. 4 is a side view of the block portion installed on an M2 shroud.
Figure 5:
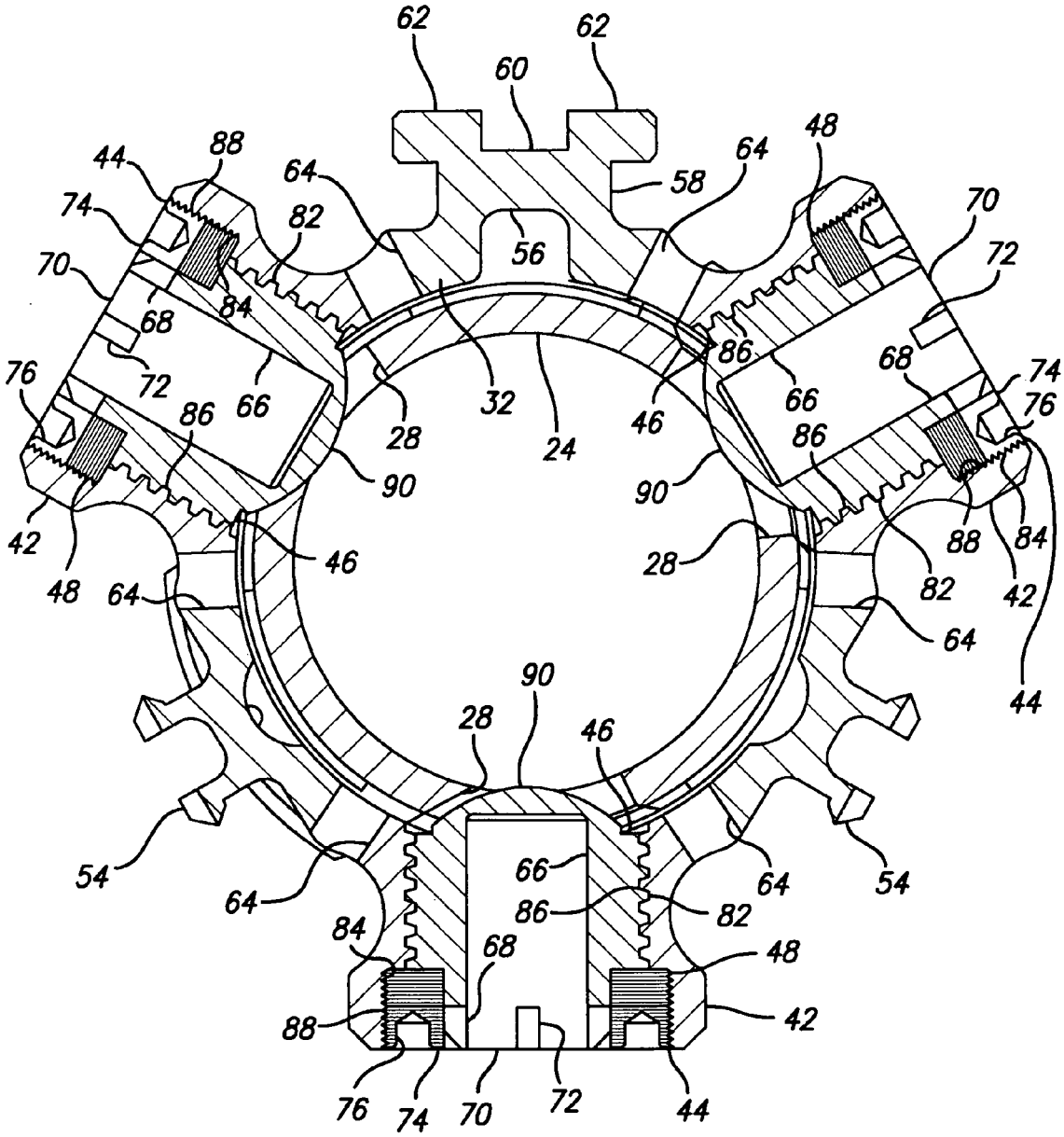
FIG. 5 is a sectional view of the block portion of FIG. 4, taken along line 5-5 in the direction of the appended arrows.

FIGS. 3, 4 and 5 show the block 32 installed on an M2 shroud 24. Each inner segment 46 of each main bore 44 contains a plug 66 having a plug tail 68 with a raised periphery 70 presenting four notches 72 in a cruciform arrangement. Preferably, each plug 66 is bored out in order to reduce its mass, in which case the plug tail 68 consists of the periphery 70 with notches 72. Each outer segment 48 of each main bore 44 contains a retaining ring 74 having an arrangement of four shallow bores 76. Each retaining ring 74 surrounds a plug tail 68.

The shroud 24 includes recurrences of a predetermined surface feature of the shroud. In a preferred embodiment, the shroud 24 is perforated by a plurality of perforations 28 (eighteen in this example) as it is presently configured. The perforations 28, formed by casting or machining, are roughly circular, about 2 cm in diameter, and arranged in six sets of three perforations 28 spaced apart about 120° in a plane perpendicular to the longitudinal axis of the shroud 24. Successive sets of perforations 28 are spaced apart about 1.5 cm longitudinally and offset by about 60°. The block 32 is located about the shroud 24 so that the two main bores 44 in each head 42 are aligned with two perforations 28 at a common angular position on the shroud 24. The two Picatinny rails 54 and the T-rail 56 are oriented substantially parallel to the longitudinal axis A of the shroud 24 and the gunbarrel 26 (see also FIG. 1). The block 32 can be realigned by ±120° with engagement to the same set of perforations 28, or by +60°, +180 or +240 with relocation to an adjacent set of perforations 28.

With continued reference to FIG. 3 and also with reference to the side elevational view of FIG. 4, an auxiliary mounting rail structure, such as an auxiliary Picatinny rail 78, has six feet 80 arranged to be bolted to the six auxiliary bores 52 in the seating surface 50 of the head 42. Thus, an additional accessory may be mounted on the auxiliary Picatinny rail 78, which may be bolted onto any of the heads 42, providing a mounting angle different from that provided by the T-rail 56 and Picatinny rails 54, which are preferably integrally formed with the block 32.

As best shown in FIG. 5, which is a sectional view of the embodiment of FIG. 4, in a preferred embodiment, each plug 66 has clockwise heavy external ACME threading 86 engaging clockwise heavy internal ACME threading 82 on the inner segment 46 of a main bore 44. The ACME threading has a rectangular profile and is used because it resists "backing out". Also in the preferred embodiment, each retaining ring 74 has counterclockwise external standard threading 88 engaging counterclockwise internal standard threading 84 of the outer segment 48 of a main bore 44. Each plug 66 has a nose 90 which is blunt, rounded, smooth, and too large to fit through a perforation 28. Thus, the nose 90 may advance only partly into the perforation 28, is relatively free to rotate against the shroud 24 when positioned at the perforation 28, and finds a stable position in the perforation 28 when tightened against the shroud 24.

With continued reference to FIG. 5, each plug 66 may be secured by placing the plug 66 in the inner segment 46 of the main bore 44 and turning it clockwise until it is snugly engaged against the shroud 24 at a perforation 28, whereupon a cruciform key bit (see FIG. 12) may be used to tighten the plug 66. After the plug 66 is tightened, a retaining ring 74 is placed in the outer segment 48 of the main bore 44 and turned counterclockwise until it is snugly engaged against the plug 66, whereupon a pegged key bit (see FIG. 13) is used to tighten the retaining ring 74.

With reference to FIGS. 3-5, an operator places the block 32 on the shroud 24 in a desired location and orientation with the plugs 66 loosely located in the main bores 44 and approximated to the desired perforations 28, and gently hand tightens the plugs 66 to reduce the slack between the block 32 and the shroud 24. If the alignment is satisfactory, the operator hand tightens the plugs 66 to eliminate the remaining slack, torques the plugs 66 with a cruciform key bit (see FIG. 12), hand tightens the retaining rings 74 until they abut the plugs 66, and finally torques the retaining rings 74 with a pegged key bit 142

(see FIG. 13) cooperatively engaging shallow bores 76 in the retaining rings 74. This procedure assures that the block 32 is satisfactorily aligned with the shroud 24, firmly attached to the shroud 24, and unlikely to be loosened by vibration or recoil.

Figure 6:
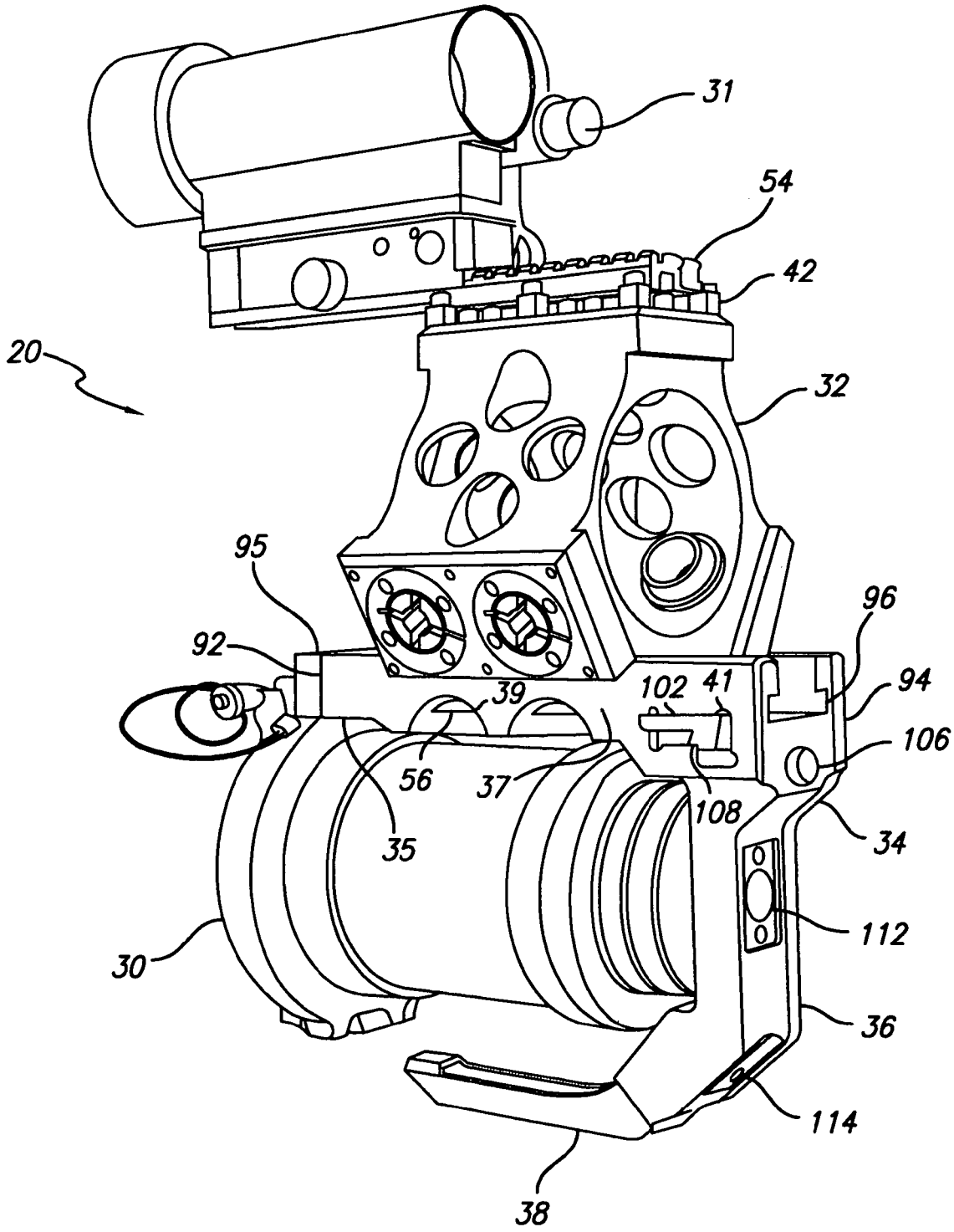
FIG. 6 is a perspective view of an embodiment of an accessory mount adapter in accordance with the present invention with a body portion with light beam generator accessory mounted on a block portion.

FIG. 6 shows a perspective view of an embodiment of an accessory mount adapter 20 in accordance with the present invention with the body 34, including a light beam generator accessory 30, mounted below the block 32 on a horizontally oriented T-rail 56 (see FIGS. 2-5) which projects downward from the block 32. An additional accessory 31 may be mounted to the adapter 20, such as on a Picatinny rail 54 which is attached to one head 42 of the block 32. The body 34 includes a forward-projecting handle 38, a downward-projecting stem 36 having a disable switch 114 and a rearward-facing electrical socket 112, and a horizontally-oriented receiver portion 35. The receiver portion 35 has left and right sides 37 including cut-outs 39 and left and right lock windows 41; a front end 92, a rear end 94, a top surface 95, and an internal T-profiled slide 96 which is closed at the front end 92 and open at the rear end 94 and at the top surface 95. A lock 102 is movably confined within the receiver portion 35 proximate the rear end 94 and has grips 108 extending leftward and rightward through the left and right lock windows 41. The lock window 41 allows the lock 102 a vertical range of motion relative to the receiver portion 35. As shown, the lock 102 is at the upward extreme of that range. A lock control pin 106 is movably confined within the receiver portion 35 proximate the rear end 94 and below the lock 102, and projects rearward through the rear end 94. The lock control pin 106 is longitudinally movable relative to the receiver portion 35. The T-rail 56 is lodged within the slide 96, the receiver portion 35 having been thrust backward onto the T-rail 56 to place the T-rail 56 firmly in contact with the front end 92. Small portions of the T-rail 56 are visible through the cut-outs 39.

Figure 7:
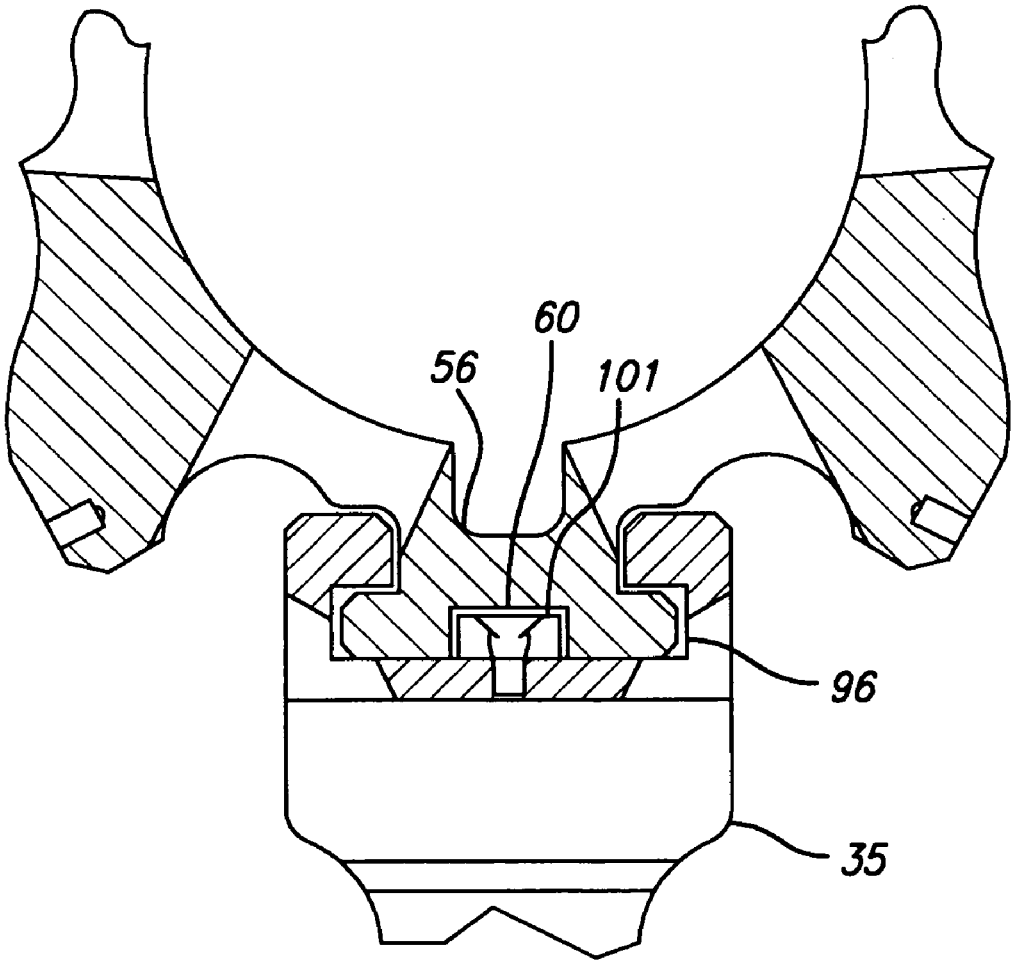
FIG. 7 is a partial sectional view of a body portion mounted to a block portion of an accessory mount adapter in accordance with the present invention.

FIG. 7 shows a rear sectional view of the receiver portion 35 mounted on the T-rail 56. The T-rail 56 occupies the slide 96. One of several centrally located guide posts 101 is shown projecting upward from the slide 96 and into the central groove 60 of the T-rail 56. The guide posts 101 align and stabilize the slide 96 on the T-rail 56.

Figure 8:
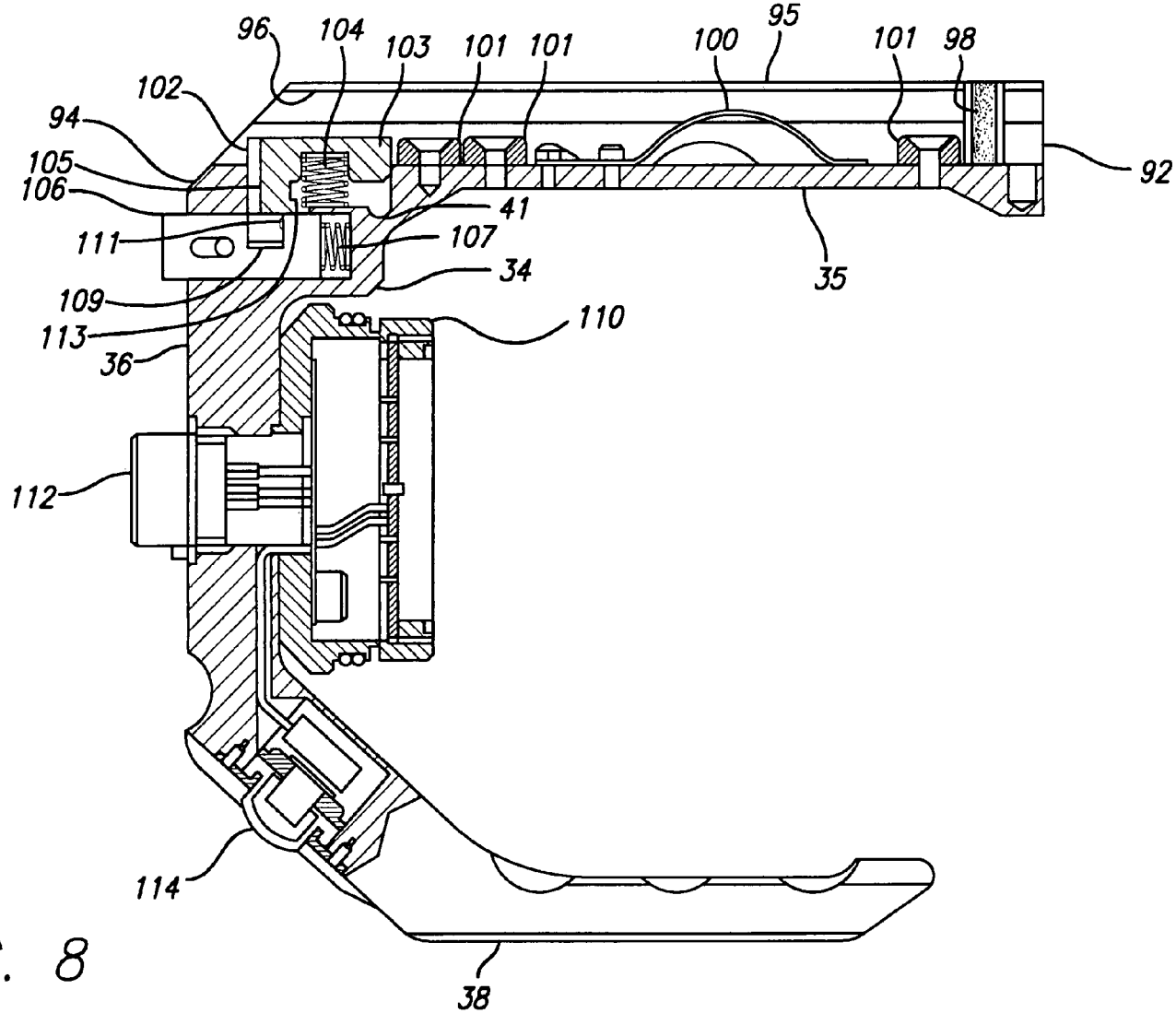
FIG. 8 is a partial sectional side view of a body portion in accordance with the present invention in a locked configuration.

With reference to FIG. 8, the lock 102 is movably positioned below the slide 96. The lock 102 includes a slide-blocking portion 103 located proximate the slide 96. Left and right lock springs 104 (only one of them is visible in this drawing figure since the two springs 104 are located on opposite sides of the T-rail groove 60 when the body 34 is installed on the T-rail) thrust upward from the receiver portion 35 and against the lock 102, biasing the lock 102 upward, such that the slide-blocking portion 103 blocks the slide 96 at the rear end 94. The lock 102 also includes a downward-projecting appendage 105 which has a rearward-projecting lip 113.

With continued reference to FIG. 8, the lock control pin 106 is mounted in the receiver portion 35 proximate the rear end 94, projects rearward therefrom, and is longitudinally movable therein. A release bias spring 107 is mounted in the receiver portion 35 proximate the rear end 94 immediately forward of the lock control pin 106 and biases the lock control pin 106 rearward.

With continued reference to FIG. 8, the lock control pin 106 has an upward-facing lock-receiving notch 109. A roll pin 111 is fixed in the lock control pin 106 and projects forward a short distance into the lock-receiving notch 109. As long as the lock control pin 106 is biased rearward, the lock-receiving notch 109 is not in position to receive the appendage 105 of the lock 102. Thus, the lock control pin 106 blocks the lock 102 from moving downward, and the slide-blocking portion 103 blocks the slide 96.

Figure 9:
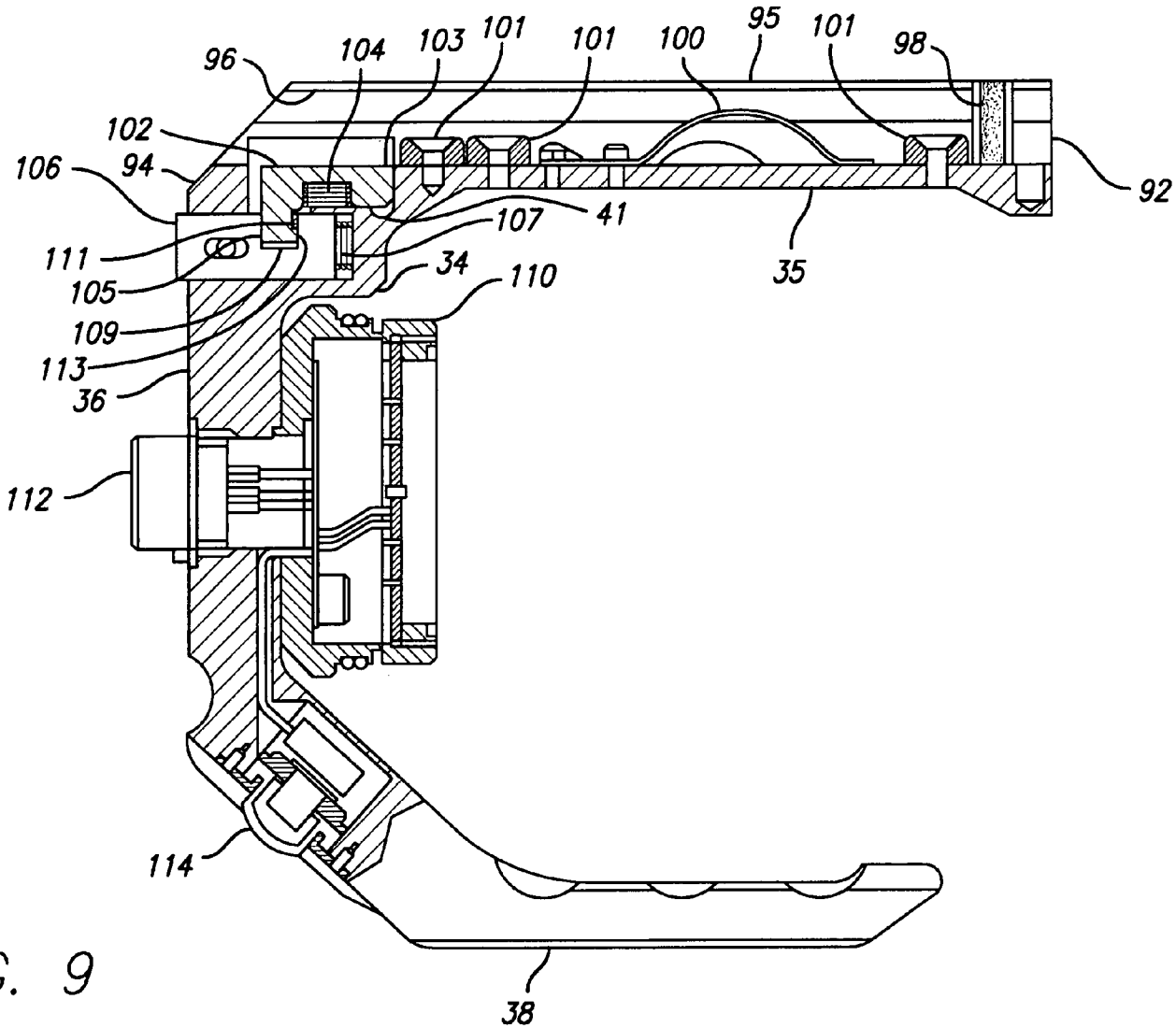
FIG. 9 is similar to FIG. 8 but with the body portion in an unlocked configuration.

With reference to FIGS. 8 and 9, the operation of the lock 102 is described. To mount the slide 96 on the T-rail 56, the slide 96 is advanced endwise onto the T-rail 56 so that the rear end 94 of the slide 96 receives the T-rail 56. To facilitate mounting the slide 96 on the T-rail 56, the lock control pin 106 is pressed forward manually, moving the lock-receiving notch 109 into position to receive the appendage 105. Next, the slide 96 is advanced onto the T-rail 56. The T-rail 56 enters the slide 96, forcing the lock 102 downward, and then continues to advance past the lock 102. To facilitate entry of the T-rail 56 into the slide 96, the laterally extending grips 108 may be pushed downward manually to move the slide-blocking portion 103 of the lock 102 clear of the slide 96, so that the T-rail 56 can more easily enter the slide 96. Thus, as shown in FIG. 9, the appendage 105 is received in the lock-receiving notch 109.

With continued reference to FIGS. 8 and 9, the receiver portion 35 includes an elastic bumper 98 located in the slide 96 near the front end 92 as well as a centrally located leaf spring 100 and three centrally located guide posts 101 projecting upward into the slide 96. As the slide 96 is advanced onto the T-rail 56, the leaf spring 100 is deflected by the T-rail 56 and stabilizes the slide 96 on the T-rail 56. At the same time, the guide posts 101 further stabilize the slide 96 on the T-rail 56. Both the leaf spring 100 and the guide posts 101 engage the central groove 60 of the T-rail 56. After the slide 96 is fully advanced onto the T-rail 56, the bumper 98, located near the front end 92, contacts the front edge of the T-rail 56 to stop further sliding of the receiver portion 35 on the T-rail 56. At this point, the T-rail 56 has also cleared the portion of the slide 96 that can be occupied by the slide-blocking portion 103 of the lock 102. Thus, after the slide 96 is advanced onto the T-rail 56 and the bumper 98 has been forced into contact with the T-rail 56, the lock bias spring 104 forces the lock 102 upward, so that the slide-blocking portion 103 blocks the slide 96 behind the T-rail 56 and prevents the T-rail 56 from escaping from the slide 96, as shown in FIG. 8. The bumper 98 may be made of an elastic material, such as rubber, such that, being compressed, it biases the T-rail 56 rearward against the slide-blocking portion 103, reducing the likelihood of play between the T-rail 56 and the slide 96.

With continued reference to FIG. 8, because the lock 102 is now biased upward toward the slide 96, the appendage 105 is disengaged from the lock-receiving notch 109, the lock control pin 106 is again biased rearward by the release bias spring 107 and is not in a position to receive the lock 102. Even if the lateral grips 108 of the lock 102 are subjected to a downward force, the lock control pin 106 will block any downward movement of the lock 102, confining the lock 102 in the upward position so that the slide-blocking portion confines the T-rail 56 inside the slide 96.

Thus, with continued reference to FIGS. 8 and 9, to dismount the slide 96 from the T-rail 56, the operator must downwardly depress the laterally extending grips 108 while pressing the lock control pin 106 forward. This moves the lock-receiving notch 109 to a position in which it may receive the appendage 105, allowing the lock 102 to move downward and away from the slide 96.

Additionally, with continued reference to FIG. 9, if the operator removes pressure from the lock control pin 106 while the appendage 105 is in the lock-receiving notch 109, the release bias spring 107 will bias the roll pin 111 forward against the appendage 105 at a point above the rearward-projecting lip 113 of the appendage 105. This interaction will hold the lock 102 in the lowered position, against the upward bias provided by the lock bias springs 104, holding the lock 102 in the open position while the slide 96 is disengaged and removed from the T-rail 56. If the operator then disturbs this interaction between the lip 113 and the roll pin 111, for example, by pressing the lock-control pin 106 forward, the lip 113 is no longer caught on the roll pin 111 and the lock will be propelled upward by the lock bias springs 104.

Figure 10:
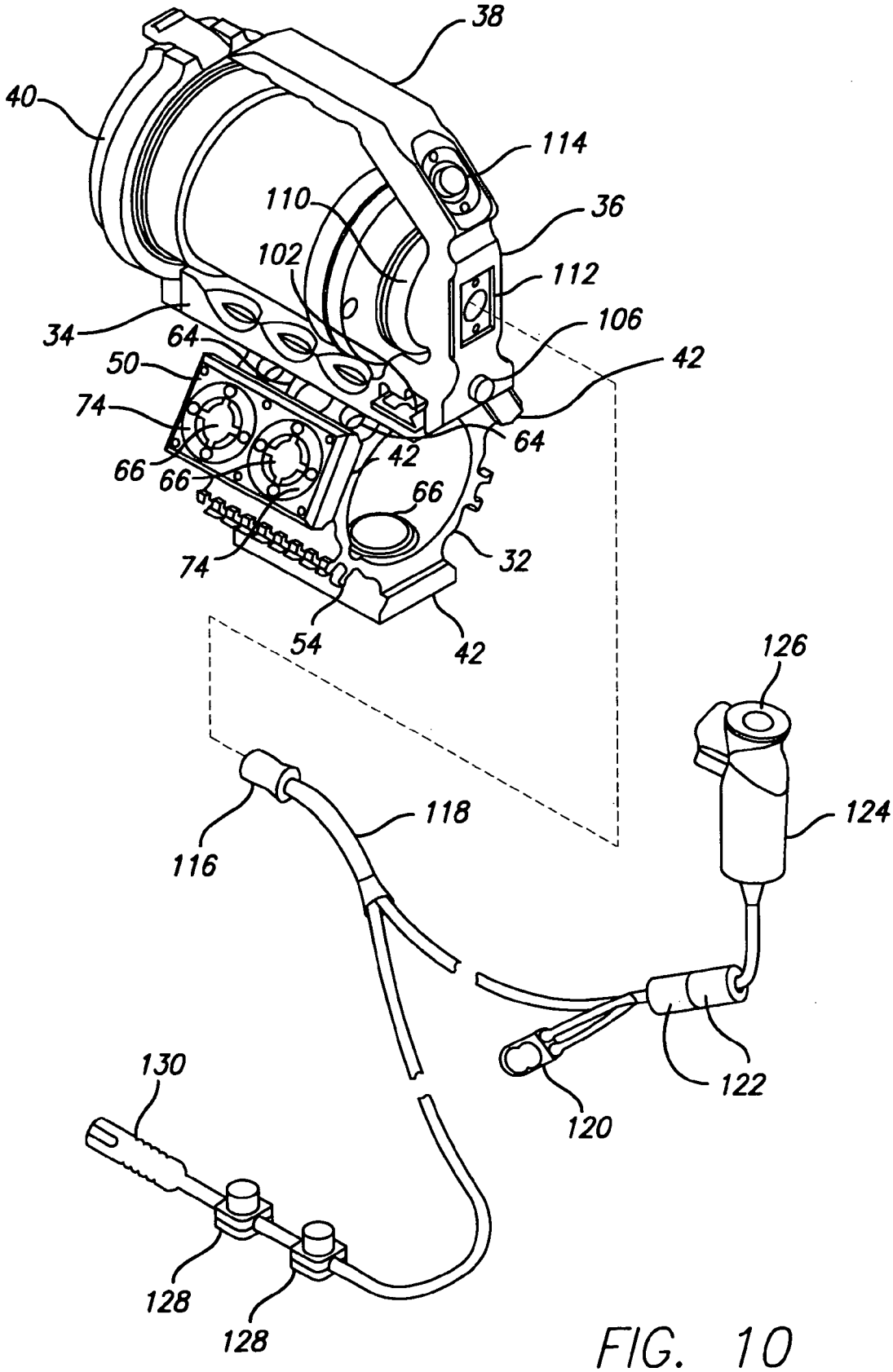
FIG. 10 is a perspective view of the light beam generator mounted to the adapter according to the present invention, partially exploded, including a cable portion thereof.

FIG. 10 shows the accessory mount adapter 20 in accordance with the present invention with the body 34 mounted on the block 32. Also shown are the electrical socket 112, disable switch 114, and lamp socket 110 with a light beam emitter 40 installed. Also shown are a socket connector 116, an electrical cable 118, a constant on-off switch 120, switch connectors 122, a hand grip 124, a hand switch 126, battery connectors 128, and a power adapter 130.

With continued reference to FIG. 10, the socket connector 116 is adapted to connect the electrical socket 112 to the electrical cable 118. The continuous on-off switch 120 is a two-position switch capable of opening and closing the connection between the socket connector 116 and the hand switch 126. The switch connectors 122 allow easy substitution of other controls for the hand switch 126 or other switch configuration. The battery connectors 128 fit a standard battery such as a 12-volt storage battery. The power adapter 130 fits a 12-volt vehicle socket.

Figure 11:
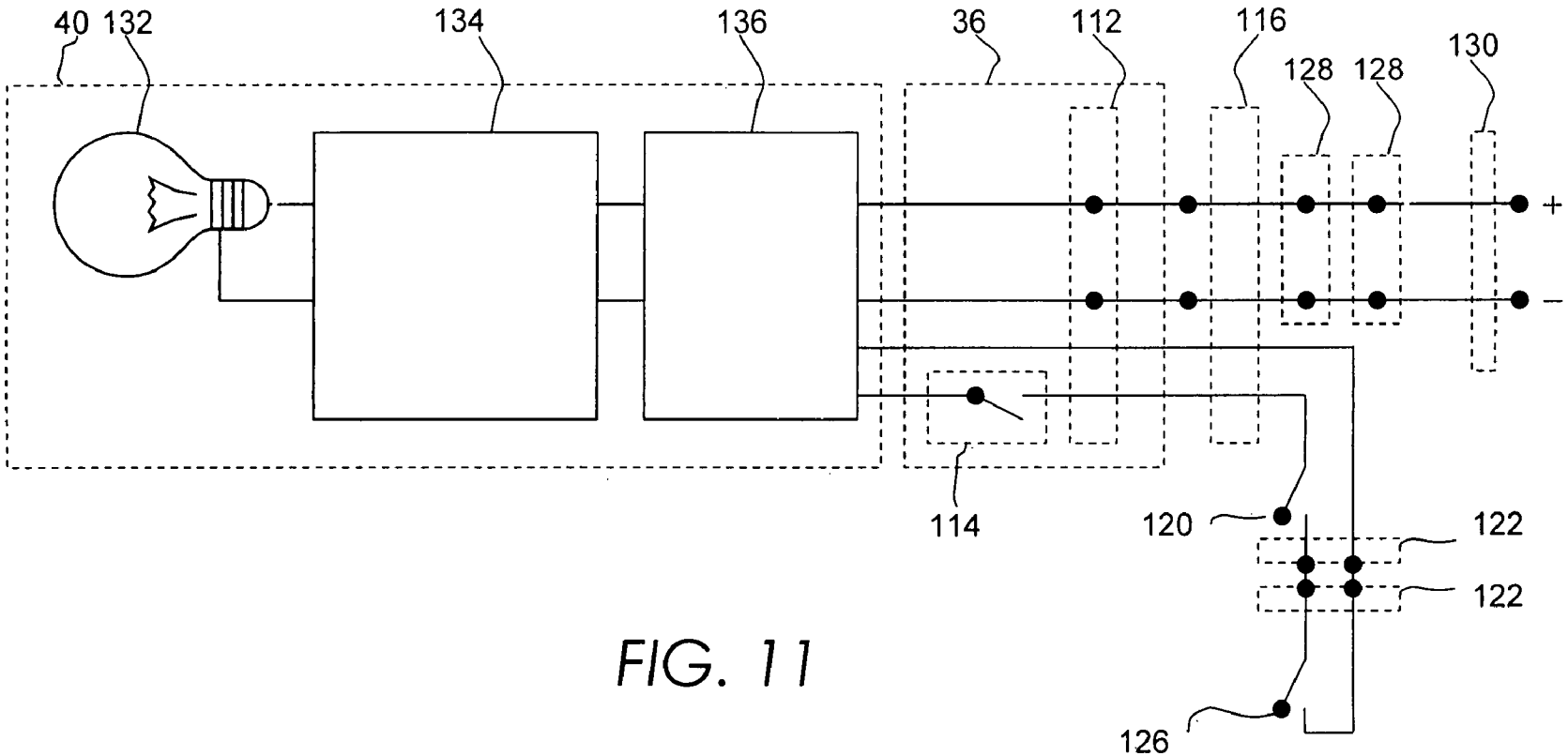
FIG. 11 is a circuit block diagram of the light beam generator and cable in accordance with the present invention.

FIG. 11 shows a circuit block diagram of an embodiment of the light beam generator 30 in accordance with the present invention. The stem 36 includes the disable switch 114 and the electrical socket 112. The electrical cable 118 includes the socket connector 116, battery connectors 128, power adapter 130, continuous on-off switch 120, and hand switch 126. As represented, the lamp assembly 40 includes a high intensity discharge light source or lamp 132, a ballast 134 for providing the proper voltage and current to the light source or lamp 132, and a logical switch 136 for controlling power to the ballast 134. The logical switch 136 preferably utilizes a FET.

With reference to FIGS. 10 and 11, because the lamp assembly 40 draws a high current, it would be disadvantageous to have a long conductive path, or switches, between the lamp assembly 40 and the battery connectors 128 and power adapter 130. To keep the current path short and simple, switches have been eliminated from the electrical cable 118 and the battery connectors 128 and the power adapter 130 are connected directly to the logical switch 136. To provide control, the disable switch 114, which may be a push-button or toggle switch, the continuous on-off switch 120, which may be a rocker switch, and the hand switch 126 are connected in series to control the logical switch 136. The disable switch 114, which is a pushbutton on-off switch, serves to disable the lamp assembly 40 when the operator needs to be sure the lamp 132 will not illuminate. The constant on-off switch 120 is a rocker on-off switch, usable as a safety switch during operations when the operator needs to continuously use both hands to operate the gun. The hand switch 126 may be a momentary switch, or any combination of constant and momentary switches, for controlling the lamp assembly 40 while aiming or firing the gun.

Figure 12:
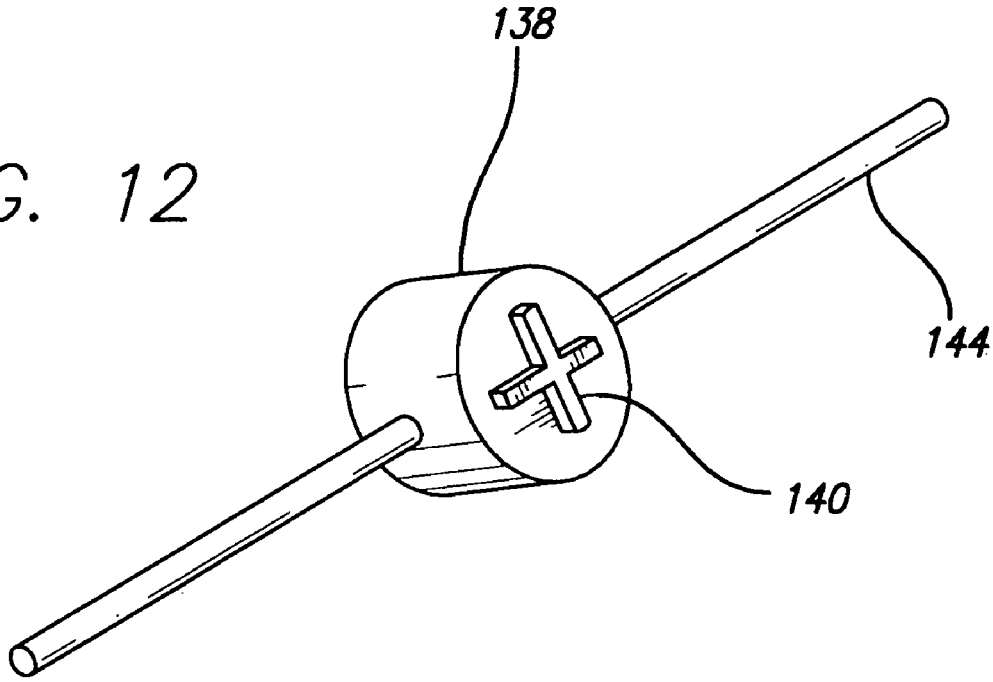
FIG. 12 is a perspective view of a key tool according to the present invention showing a cruciform key bit.
Figure 13:
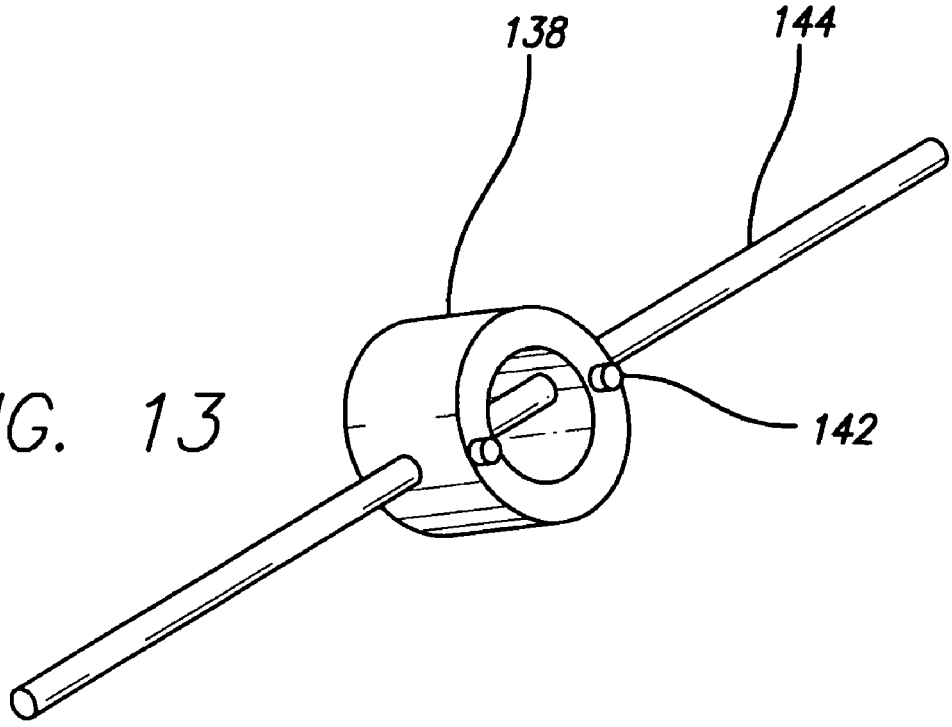
FIG. 13 is a perspective view of a key tool according to the present invention showing a pegged key bit.

FIGS. 12 and 13 show a key tool 138 having a cruciform bit 140 on one face, a peg bit 142 on the other, and a torque arm 144 slidably threaded through the middle. The torque arm 144 in some embodiments of the present invention may have oversized ends so that it is not separated from the key tool 138 and lost.

In the preferred embodiment, the block 32, plug 66, retaining ring 74, body 34, and key tool 138 are formed of steel, aircraft aluminum, titanium, or other rigid durable material. The Picatinny rails 54, T-rail 56, and heads 42 are preferably formed integrally with the block. The electrical cable 118 includes insulated copper conductors enclosed in a sheath and adapted to connect to batteries and power sources which are expected to be found in the intended environment.

While the foregoing detailed description has described a preferred embodiment of an accessory mount adapter in accordance with the present invention, it is to be understood that the above description is illustrative only and not limiting of the disclosed invention. For example, it is not necessary to use the exact number of plugs 66 shown in the drawing, nor is it necessary for the shroud 24 to have the exact number, shape, or arrangement of perforations 28. The blunt-nosed plugs 66 of the present invention are effective in stabilizing the block 32 on a shroud 24 having a wide variety of surface characteristics, although other plug configurations may be useful as well. Indeed, it will be appreciated that the embodiments discussed above and the virtually infinite embodiments that are not mentioned could easily be within the scope and spirit of the present invention. Thus, the present invention is to be limited only by the claims as set forth below.

What is claimed is:

1. Apparatus for mounting equipment, comprising:

a first component including a rail;

a second component including a slide adapted for longitudinal engagement to said rail, said slide having an open end adapted for receiving said rail endwise;

a lock movably confined in said second component proximate said open end, said lock having a closed position wherein said lock confines said rail in said open end and an open position wherein said open end may receive or release said rail;

an appendage projecting from said lock; and a control pin movably confined in said second component proximate said lock, said control pin having a notch shaped and oriented to receive said appendage, said control pin having a free position wherein said notch is aligned to receive said appendage thereby allowing said lock to be in said open position, and a blocking position wherein said notch is misaligned with said appendage thereby preventing said lock from being in said open position.

2. Apparatus as set forth in claim 1, including:

a light emitter assembly carried by said second component.

3. Apparatus as set forth in claim 1, wherein said lock is biased in said closed position.

4. Apparatus as set forth in claim 3, wherein said control pin is biased in said blocking position and manually movable to said free position.

5. Apparatus as set forth in claim 1, wherein said lock has lateral projections adapted for manually moving said lock between said closed and open positions.

6. Apparatus as set forth in claim 4, wherein said control pin is movable from said free position to said blocking position only when said lock is in said closed position.

7. Apparatus as set forth in claim 6, said apparatus further including a first surface feature on said appendage and a second surface feature on said control pin, said first surface feature and said second surface feature being adapted to cooperate to retain said lock in said open position while said appendage retains said control pin in said free position.

* * * * *